US005725694A

United States Patent [19]

Sircar

[11] Patent Number: 5,725,694

[45] Date of Patent: Mar. 10, 1998

[54] FREE-MACHINING ALUMINUM ALLOY AND METHOD OF USE

[75] Inventor: Subhasish Sircar, Richmond, Va.

[73] Assignee: Reynolds Metals Company, Richmond, Va.

[21] Appl. No.: 756,302

[22] Filed: Nov. 25, 1996

[51] Int. Cl.[6] ..... C22C 21/00

[52] U.S. Cl. ..... 148/439; 420/554; 420/535; 420/536; 420/529; 420/530; 420/532; 148/437; 148/439

[58] Field of Search ..... 420/554, 535, 420/536, 529, 530, 532; 148/437, 439

[56] References Cited

U.S. PATENT DOCUMENTS

| | | | |
|---|---|---|---|
| 1,959,029 | 5/1934 | Kempf et al. | 75/1 |
| 2,649,368 | 8/1953 | Smith et al. | 75/134 |
| 3,616,420 | 10/1971 | Broughton | 204/197 |
| 4,005,243 | 1/1977 | Baba et al. | 428/469 |
| 4,082,573 | 4/1978 | Schoerner et al. | 148/2 |
| 4,196,021 | 4/1980 | Bouvaist et al. | 148/2 |
| 4,196,262 | 4/1980 | Pryor et al. | 428/654 |
| 4,214,903 | 7/1980 | Murabayashi et al. | 75/134 D |
| 4,244,737 | 1/1981 | Holowaty et al. | 75/129 |
| 4,375,499 | 3/1983 | Nara et al. | 428/653 |
| 4,412,972 | 11/1983 | Mori | 420/530 |
| 4,452,866 | 6/1984 | Kamiya et al. | 428/653 |
| 4,631,172 | 12/1986 | Yamamoto et al. | 420/541 |
| 4,632,885 | 12/1986 | Tanabe et al. | 428/654 |
| 4,634,656 | 1/1987 | Ohashi et al. | 430/278 |
| 4,751,086 | 6/1988 | Jeffrey et al. | 429/218 |
| 4,885,045 | 12/1989 | May | 148/440 |
| 5,122,208 | 6/1992 | Alabi | 148/440 |
| 5,162,100 | 11/1992 | Tanaka et al. | 420/530 |
| 5,282,909 | 2/1994 | Ara et al. | 148/439 |
| 5,286,445 | 2/1994 | Kamiya | 420/530 |
| 5,328,078 | 7/1994 | Okumura | 228/179.1 |
| 5,587,029 | 12/1996 | Sircar | 148/438 |

FOREIGN PATENT DOCUMENTS

| | | | |
|---|---|---|---|
| 0136866 | 4/1985 | European Pat. Off. | B22F 9/08 |
| 0136866B1 | 4/1985 | European Pat. Off. | B22F 9/08 |
| 52-20312 | 2/1977 | Japan | 420/530 |
| 61-159547 | 7/1986 | Japan | 420/530 |

*Primary Examiner*—David A. Simmons
*Assistant Examiner*—M. Alexandra Elve
*Attorney, Agent, or Firm*—Alan M. Biddison

[57] ABSTRACT

A free-machining alloy is disclosed containing bismuth, tin and indium. The free-machining constituents act as low melting point compounds for machining and are specially adapted for use in aluminum alloys such as AA6000 series and AA 2000 series alloys. The bismuth, tin and indium are effective replacements for the lead and bismuth addition used previously to improve machinability.

20 Claims, No Drawings

FREE-MACHINING ALUMINUM ALLOY AND METHOD OF USE

FIELD OF THE INVENTION

The present invention is directed to free-machining alloys and, in particular, to free-machining aluminum alloys which contain bismuth, tin and indium.

BACKGROUND ART

Free-machining aluminum alloys are well known in the art. These alloys typically include free-machining constituents such as lead, tin and bismuth for improved machinability. These constituents form low melting point compounds which readily melt or soften due to the friction heat created during machining. Thus, material removal required for the manufacture of complex parts and components is easily facilitated.

During machining, free-machining alloys generate small chips or curls which are easily collected and do not interfere with the machining process. It is essential that these free-machining aluminum alloys form these small chips or curls for proper machining. Formation of long continuous strips or curls is totally unacceptable in machining since the curls or strips may wrap around the work piece or machining tool and disrupt the operation. Poor machinability also affects other machining operations since the operator must attend to a single machining operation and cannot effectively supervise a multiplicity of operations, as is commonly done in practice. AA6061 alloys are generally unacceptable for machining since they form these long continuous curls during machining.

U.S. Pat. Nos. 2,026,457 and 2,026,575 to Kempf et al. disclose free cutting aluminum alloys. Similarly, U.S. Pat. No. 4,005,243 to Baba et al. discloses a freely machinable aluminum alloy.

Other known machinable alloys include AA6262 and AA2011, 2012 and 2111.

While the prior art aluminum alloys provide adequate free machinability, they are not without drawbacks and/or disadvantages. For example, AA6262 contains lead and chips from machining this alloy represent a hazardous waste disposal problem.

Prior art alloys containing bismuth, e.g., AA2011 and AA2111, can adversely effect the final mechanical properties of the machined part. Since bismuth has some affinity for magnesium, the bismuth in these alloys has a tendency to combine with the magnesium to prevent or reduce $Mg_2Si$ formation potential for precipitation strengthening. Bismuth also has a poor affinity for tin, and alloys having these two components may not always form the desired low melting point compounds for free-machining.

As a solution to the problems identified above, the inventor has proposed free-machining aluminum alloys containing tin and indium as a means to eliminate both lead and bismuth as constituents in free-machining alloys. This alloy system is disclosed in U.S. patent application Ser. No. 08/330,514, titled "Machineable Aluminum Alloys Containing In and Sn and Process for Producing the Same", filed Oct. 27, 1994, which is herein incorporated by reference in its entirety.

Although free-machining alloys containing the aforementioned indium and tin provide excellent machining properties, the presence of indium makes the alloys somewhat unattractive from an economical stand point.

As such, a need has developed to provide an environmentally friendly free-machining alloy which does not have its final mechanical properties compromised by free-machining constituents therein and which is economically viable.

SUMMARY OF THE INVENTION

Accordingly, it is a first object of the present invention to provide a free-machining aluminum alloy which eliminates lead and its adverse effects on the environment during machining chip disposal.

Another object of the present invention is to provide a free-machining aluminum alloy containing bismuth, indium and tin which has at least comparable free-machining properties as prior art alloys.

Another object of the present invention is to provide an economically attractive free-machining alloy.

A still further object of the present invention is to provide a method of machining using a lead free free-machining alloy which utilizes bismuth, indium and tin as a low melting point compound for machinability.

Other objects and advantages of the present invention will become apparent as a description thereof proceeds.

In satisfaction of the foregoing objects and advantages, the present invention provides an improvement over the prior art free-machining alloys containing low melting point free-machining constituents. According to the invention, an effective amount of tin, bismuth and indium is utilized in these types of alloys as free-machining constituents, i.e., low melting point compounds.

The effective amounts of bismuth, tin and indium can be added to alloy chemistries typical of free-machining alloys such as AA6000 or AA2000 series alloys or other alloys, ferrous or non-ferrous. The effective amounts are such that the bismuth, tin and indium form the low melting point compounds in an amount which, when dispersed throughout the alloy shape being machined, generate chips rather than long curls or stringers during machining. Preferably, the free-machining alloying constituents can range, in vol. %, up to 1.0 (preferably up to about 0.7, and, more preferably, up to about 0.5). The lower limit, in some cases, is 0.1 vol. %. In other cases, the lower limit is 0.2 or 0.3 vol. %. While amounts greater than 1.0 vol. % might increase machinability, the improvement in machinability might have an unacceptable impact on alloy properties. The lower limit is a function of the desired improvement in machinability. If the amount is too low, the low melting point constituents will be too dispersed to have any significant impact on machinability.

Preferably, the amounts of Bi, In and Sn are added so that their respective weight percentages in the alloy range between about 0.10 to 0.7 Bi, 0.03 to 0.40 In and 0.10 to 0.80 Sn.

More preferably, the present invention discloses a free-machining alloy wherein the bismuth ranges between about 0.2 and 0.5 wt. % (preferably between about 0.30–0.35% wt. %), the indium ranges between about 0.03 and 0.2 wt. % (preferably between about 0.07 and 0.10 wt. %) and the tin ranges between about 0.2 and 0.6 wt. % (preferably between about 0.38 and 0.44 wt. %). Most preferably, the bismuth, indium and tin are maintained in an eutectic ratio.

The bismuth, tin and indium can be added as substitutes for the free-machining constituents in AA6262 and AA2111 free-machining aluminum alloys. In addition, they may be added to other alloys to improve machinability.

BRIEF DESCRIPTION OF THE PREFERRED EMBODIMENTS

The present invention is an improvement over prior art free-machining alloys.

According to the invention, an effective amount of bismuth, tin and indium can be used to provide free-machining. Bismuth, tin and indium are principally substituted for the free-machining or low melting point constituents in prior art free machining alloys, such as lead and bismuth or bismuth and tin.

An effective amount of bismuth, tin and indium is a respective amount for each alloying component that, when combined with each other and other alloying constituents, forms a low melting point compound as part of the alloy and results in a free-machining alloy that generates the proper size machine chips or curls for effective machining operation.

While bismuth has a low affinity for tin so that the two form only limited amounts of a low melting point eutectic, the addition of indium, even in small amounts, provides a surprising impact in that surprisingly large amounts of a ternary low melting point eutectic are formed. This ternary eutectic also has a substantially lower melting point than the bismuth-tin eutectic.

Preferably, the ratios between the amounts of bismuth, tin and indium added, in weight %, fall within the following ranges: bismuth—40 to 60%, tin—25 to 50%, and indium—5 to 20%.

The effective amount of bismuth, tin and indium, when added to a standard alloy such as a steel or an aluminum alloy, forms a low melting point compound, preferably a low melting eutectic in the alloy. With this low melting point compound present in the alloy, a local increase in the alloy temperature due to machining of an article made from the alloy brings the low melting point compound to a soft or liquid state. In this state, the low melting point compound loses its strength thereby facilitating the formation of a chip. The chip can then be easily removed from the machining area without interfering with the machining process. This contrasts with prior art alloys which have a tendency to form long stringers or curls which can interfere with the machining process.

It has been discovered that the use of tin, indium and bismuth as free-machining constituents for an alloy to be machined offers significant improvements over prior art systems using lead-bismuth and bismuth-tin. The well recognized problem with lead-bismuth systems is that a large amount of the lead-bismuth addition is needed to obtain the necessary volume percent in the alloy for free-machining. Since lead is extremely dense, large additions are needed which increase the environmental unacceptability of these types of alloys. These systems also have a potential problem in that the eutectic point of the low melting compound is about 125° C.

Bismuth-tin systems, while being lead free, do not machine nearly as well as lead-containing systems. These bismuth-tin systems are also disadvantageous in that the eutectic melting point is 140° C. which is even higher than that of the lead-bismuth systems discussed above.

The invention, in one aspect, is an improvement over the bismuth-tin systems in that the addition of indium lowers the melting point of the thus-formed ternary compound. As an added benefit, bismuth levels can be reduced. It has been discovered that a bismuth-tin-indium ternary eutectic having a melting temperature less than about 100° C., provides acceptable free-machining properties. This low melting point eutectic is environmentally friendly, i.e., lead free, and uses low amounts of indium for cost effectiveness.

Since the inventive free-machining alloys are lead free, there is no problem in achieving the necessary volume percent in the article for acceptable machining properties, while still maintaining cost effectiveness. It is believed that when using the bismuth-tin-indium low melting point compound, a volume percent of up to about 1.0% provides acceptable machining capability, preferably 0.1 to 0.5%, more preferably 0.1 to 0.3% and, still more preferably, about 0.2%. Of course, the volume percent may vary depending on the alloy system being used in conjunction with the bismuth-tin-indium addition, the machining process being used with the article or articles formed from the alloy, the desired impact on machining properties of the article, and the acceptable change in properties of the alloy associated with the addition.

When adding the bismuth, tin and indium to a particular alloy, it is preferred that the thus-formed low melting point ternary compound be finely dispersed throughout the alloy article to be machined. Without a fine dispersion or distribution of the ternary compound, a machining tool may come into contact with portions of the alloy article being machined that are devoid of the low melting point compound. Machining these areas may result in formation of long stringers or the like rather than chips. The stringers then adversely affect the overall machining process.

When using bismuth, tin and indium free-machining constituents in an aluminum-based alloy which is heat treatable, the appropriate controls can be utilized during the various processing steps used to form the alloys into articles and shapes for machining, e.g., working, quenching, annealing, solution heat treating, aging, etc. Since obtaining a fine distribution or dispersion of free-machining constituents in aluminum and other alloys is well known, a further description of these techniques is not deemed necessary for understanding of the invention.

As stated above, it is believed that the use of a bismuth-tin-indium low melting point compound applies to ferrous and non-ferrous alloys. This system is useful with AA6000, AA7000 and AA2000 series aluminum alloys, as well as other aluminum alloys.

Table 1 sets forth, in weight percent, an example of using the bismuth-tin-indium low melting point compound in an AA6000 series aluminum alloy. Table 2 provides the results of machining tests of AA6061-type alloys that have been modified to include the indicated amounts, in weight %, of bismuth, tin, and indium. The machining tests involved turning a 0.975 inch (2.48 cm) rod to 0.875 inches ((2.22 cm) at an rpm of 2000 and a feed rate of 0.005 inches (0.013 cm) per minute. No chip breakers or lubricants were used.

TABLE 1

| | Broader Limits | Preferred Limits |
|---|---|---|
| Si | 0.40–0.8 | 0.55–0.65 |
| Fe | 0.7 max. | 0.30 max. |
| Cu | 0.15–0.40 | 0.17–0.33 |
| Mn | 0.15 max. | 0.10 max. |
| Mg | 0.8–1.2 | 0.90–1.10 |
| Cr | 0.04–0.35 | 0.06–0.12 |
| Zn | 0.25 max. | 0.05 max. |
| Ti | 0.15 max. | 0.05 max. |
| In | 0.03–0.40 | 0.03–0.2 |
| Bi | 0.10–0.7 | 0.2–0.5 |
| Sn | 0.10–0.8 | 0.2–0.6 |
| O/E | 0.05 max. | 0.05 max. |
| O/T | 0.15 max. | 0.15 max. |
| Al | balance | balance |

O/E Others elements/each
O/T Other elements/total

TABLE 2

| NO. | TIN | INDIUM | BISMUTH | WEIGHT (GMS/20 CHIPS) | OBSERVATIONS |
|---|---|---|---|---|---|
| 1 | 0.26 | 0.05 | 0.39 | 0.7 | medium chips |
| 2 | 0.18 | 0.04 | 0.30 | 1.1 | medium curly chips |
| 3 | 0.13 | 0.02 | 0.19 | — | continuous curly string |
| 3a | 0.13 | 0.02 | 0.19 | — | continuous curly string |
| 4 | 0.33 | 0.07 | 0.29 | 0.5 | small to medium chips |
| 5 | 0.23 | 0.05 | 0.23 | 0.6 | small to medium chips |
| 6 | 0.16 | 0.03 | 0.16 | 2.8 | medium curls broken |
| 7 | 0.23 | 0.11 | 0.37 | 0.5 | small chips, curly chips |
| 8 | 0.17 | 0.08 | 0.27 | 0.8 | small to medium chips |
| 9 | 0.11 | 0.05 | 0.19 | — | continuous medium curls |
| 10 | 0.18 | 0.12 | 0.40 | 1.6 | small curls to 1.5" long (3.8 cm) |
| 10a | 0.18 | 0.12 | 0.40 | 2.4 | small curls to 3" long (7.6 cm) |
| 11 | 0.13 | 0.09 | 0.30 | 0.8 | medium chips |
| 12 | 0.10 | 0.05 | 0.22 | 1.0 | small chips |
| 17 | 0.09 | 0.05 | 0.21 | 1.9 | large curly chips |
| 18 | 0.12 | 0.08 | 0.29 | 1.8 | small curls to 2" long (5.1 cm) |
| 19 | 0.18 | 0.11 | 0.38 | 1.2 | small curls to 1.5" long (3.8 cm) |
| 21 | 0.13 | 0.25 | 0.49 | 1.0 | small curls to 1.5" long (3.8 cm) |
| 22 | 0.08 | 0.14 | 0.29 | 1.4 | small to medium curls |
| 30 | 0.27 | 0.08 | 0.26 | | large continuous curls |
| 31 | 0.27 | 0.08 | 0.26 | | medium continuous curls |

Although an AA6000 series aluminum alloy is exemplified in Table 1, the broad weight percentages for In, Sn and Bi set forth are believed to apply to other alloys such as AA2111 or steels.

It has been shown that an aluminum alloy with a volume fraction of 0.2% of a bismuth-tin-indium ternary having a melting temperature of about 100° C. or less has improved machinability over an AA6061 alloy.

As stated above, systems using just bismuth and tin have not exhibited a dramatic improvement in machinability. It is believed that the relatively high melting point of a non-eutectic bismuth-tin phase in these systems, as compared to eutectic lead-bismuth systems or indium-tin systems, may be related to the lack of good machinability. It is believed that combining indium with bismuth and tin lowers the melting point of the thus-formed ternary and, in turn, improves the machinability of the ternary-containing alloy significantly.

In the inventive method, an article or shape is made of an alloy containing the free-machining constituents, bismuth, tin and indium. The alloy can be made using any conventional techniques known to one of ordinary skill in the art. Similarly, conventional methodology can be used to form the alloy into a desired shape for machining. Once the alloy is made into a shape, e.g., a bar, rod or other work piece with the free-machining constituents as components thereof, the work piece can then be machined without interference from the machining debris since the debris is basically in the form of machining chips rather than mostly long curls, stringers or other elongated pieces. The machining can be any type known in the art.

As stated above, it is believed that the bismuth, tin and indium alloy constituents can also be used in free-machining alloy steels which may use undesirable free-machining constituents such as lead or the like. These steels include both austenetic and ferritic stainless steels as well as low carbon, medium carbon and alloy grade steels.

In summary, the present invention provides for the addition of a low melting eutectic to conventional alloys, such as AA 2000 (copper is principal alloying element) and AA6000 (alloys contain silicon and magnesium in approximate proportions to form magnesium silicide) series alloys, to improve their machinability. Tests have shown that an addition of indium and tin improves machinability, as does an addition of lead and bismuth. The addition of lead is unattractive because of environmental issues. The cost of indium has made the addition of indium and tin economically unattractive. Binary Bi—Sn has a melting point of 139° C.; binary Pb—Bi has a melting point of 126° C.; and binary In—Sn has a melting point of 120° C. Tests have shown that machinability is not improved significantly by the addition of Bi—Sn. This might be because the melting point of Bi—Sn is higher than that of Pb—Bi and In—Sn. Addition of a relatively small amount of In to a Bi—Sn binary provides a good solution. The melting point of the ternary is lower than that of the binary so that products formed from alloys containing the ternary have good machinability.

As such, an invention has been disclosed in terms of preferred embodiments thereof which fulfill each and every one of the objects of the present invention as set forth above and provide a new and improved free-machining alloy and a method of use.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A free-machining lead free aluminum alloy comprising an aluminum alloy including a low melting point eutectic compound consisting essentially of indium, tin and bismuth in a volume percent of said lead free aluminum alloy which firstly causes the low melting point compound to soften or melt during machining and secondly generates chip-like machining debris.

2. The alloy of claim 1 wherein the aluminum alloy is one of an AA6000 or AA2000 series alloy.

3. The alloy of claim 1 wherein the volume percent is up to 1.0%.

4. The alloy of claim 1 wherein the eutectic compound has a melting point of less than 100° C.

5. The alloy of claim 1 having a composition consisting essentially of, in weight percent:

0.40 to 0.80 Si;
0.15 to 0.40 Cu;
0.8 to 1.2 Mg;
up to 0.35 Cr;
0.03 to 0.40 In;
0.10 to 0.70 Bi;
0.10 to 0.80 Sn;
up to 0.7 Fe;
up to 0.15 Mn;

up to 0.25 Zn;

up to 0.15 Ti;

with the balance aluminum and incidental impurities.

6. The alloy of claim 5 wherein the Sn ranges between 0.2 and 0.6, the Bi ranges between 0.2 and 0.5 and the In ranges between 0.3S and 0.2.

7. The alloy of claim 5 wherein the Si ranges between 0.55 and 0.65, the Cu ranges between 0.17 and 0.33, the Cr ranges between 0.06 and 0.12.

8. The alloy of claim 5 wherein the Sn ranges between 0.38 and 0.44, the Bi ranges between 0.30 and 0.35 and the In ranges between 0.07 and 0.10.

9. The alloy of claim 1 wherein the In ranges between 0.03 and 0.40 wt %, the Bi ranges between 0.10 and 0.70 wt. % and the Sn ranges between 0.10 and 0.80 wt. % of said lead free aluminum alloy.

10. A free-machining lead free alloy including a low melting point compound, wherein the low melting point compound consists essentially of indium, tin and bismuth in a volume percent of said lead free aluminum compound which causes the low melting point compound to soften or melt during machining to thereby generate chip-like machining debris.

11. The alloy of claim 10 wherein the indium ranges between 0.03 and 0.40 wt. %, the bismuth ranges between 0.10 and 0.70 wt. % and the tin ranges between 0.10 and 0.80 wt. % of the free-machining lead free alloy.

12. The alloy of claim 11 wherein the tin ranges between 0.38 and 0.44, the bismuth ranges between 0.30 and 0.35 and the indium ranges between 0.07 and 0.10.

13. The alloy of claim 3 wherein the indium ranges between 0.03 and 0.40 wt. %, the bismuth ranges between 0.10 and 0.70 wt. % and the tin ranges between 0.10 and 0.80 wt. % of the lead free alloy.

14. The alloy of claim 4 wherein the indium ranges between 0.03 and 0.40 wt. %, the bismuth ranges between 0.10 and 0.70 wt. % and the tin ranges between 0.10 and 0.80 wt. % of the lead free aluminum alloy.

15. The alloy of claim 3 having a composition consisting essentially of, in weight percent:

0.40 to 0.8 Si;

0.15 to 0.40 Cu;

0.8 to 1.2 Mg;

0.04 to 0.35 Cr;

0.03 to 0.40 In;

0.10 to 0.70 Bi;

0.10 to 0.80 Sn;

up to 0.7 Fe;

up to 0.15 Mn;

up to 0.25 Zn;

up to 0.15 Ti;

with the balance aluminum and incidental impurities.

16. The alloy of claim 15 wherein the tin ranges between 0.38 and 0.44, the bismuth ranges between 0.30 and 0.35 and the indium ranges between 0.07 and 0.10.

17. The alloy of claim 15 wherein the Si ranges between 0.55 and 0.65, the Cu ranges between 0.17 and 0.33, and the Cr ranges, between 0.06 and 0.12.

18. The alloy of claim 1 wherein, in weight percent, the tin ranges between 0.38 and 0.44, the bismuth ranges between 0.30 and 0.35 and the indium ranges between 0.07 and 0.10.

19. The alloy of claim 18 further comprising Si in a range between 0.55 and 0.65, Cu in a range between 0.17 and 0.33, and Cr in a range between 0.06 and 0.12.

20. The alloy of claim 12 further comprising Si in a range between 0.55 and 0.65, Cu in a range between 0.17 and 0.33, and Cr in a range between 0.06 and 0.12.

* * * * *